US009453640B2

(12) United States Patent
Krichtafovitch et al.

(10) Patent No.: US 9,453,640 B2
(45) Date of Patent: Sep. 27, 2016

(54) BURNER SYSTEM WITH ANTI-FLASHBACK ELECTRODE

(71) Applicant: ClearSign Combustion Corporation, Seattle, WA (US)

(72) Inventors: Igor A. Krichtafovitch, Kirkland, WA (US); Joseph Colannino, Bellevue, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 756 days.

(21) Appl. No.: 13/907,825

(22) Filed: May 31, 2013

(65) Prior Publication Data

US 2013/0323655 A1 Dec. 5, 2013

Related U.S. Application Data

(60) Provisional application No. 61/653,722, filed on May 31, 2012, provisional application No. 61/669,634, filed on Jul. 9, 2012.

(51) Int. Cl.

| | |
|---|---|
| ***F23C 99/00*** | (2006.01) |
| ***F23D 14/82*** | (2006.01) |
| ***F23D 14/02*** | (2006.01) |
| ***F23D 11/40*** | (2006.01) |

(52) U.S. Cl.

CPC ..... *F23C 99/001* (2013.01); *F23D 11/406* (2013.01); *F23D 14/02* (2013.01); *F23D 14/82* (2013.01)

(58) Field of Classification Search

CPC ..... F23C 99/001; F23D 14/02; F23D 14/82
USPC ..... 431/8, 2, 18, 264; 60/779, 772
See application file for complete search history.

(56) References Cited

U.S. PATENT DOCUMENTS

| | | | |
|---|---|---|---|
| 1,153,182 | A | 9/1915 | Schniewind |
| 2,604,936 | A | 7/1952 | Kaehni et al. |
| 3,087,472 | A | 4/1963 | Asakawa |
| 3,224,485 | A | 12/1965 | Blomgren et al. |
| 3,306,338 | A | 2/1967 | Wright |
| 3,358,731 | A | 12/1967 | Donnelly |
| 3,416,870 | A | 12/1968 | Wright |
| 3,503,348 | A | 3/1970 | Dvirka |
| 3,749,545 | A | 7/1973 | Velkoff |

(Continued)

FOREIGN PATENT DOCUMENTS

| | | |
|---|---|---|
| WO | WO 96/01394 | 1/1996 |

OTHER PUBLICATIONS

Altendrfner et al., "Electric Field Effects on Emissions and Flame Stability With Optimized Electric Field Geometry", Third European Combustion Meeting ECM 2007, p. 1-6.

(Continued)

*Primary Examiner* — Gregory Huson
*Assistant Examiner* — Nikhil Mashruwala
(74) *Attorney, Agent, or Firm* — Christopher A. Wiklof; Nicholas S. Bromer; Launchpad IP, Inc.

(57) ABSTRACT

A premixed fuel and air combustion system includes an anti-flashback electrode configured to repel a charge concentration in a combustion fluid and reduce or prevent the flame from flashing back into a mixer.

34 Claims, 8 Drawing Sheets

(56) References Cited

U.S. PATENT DOCUMENTS

| | | | |
|---|---|---|---|
| 3,841,824 | A | 10/1974 | Bethel |
| 3,869,362 | A | 3/1975 | Machi et al. |
| 4,052,139 | A | 10/1977 | Paillaud et al. |
| 4,091,779 | A | 5/1978 | Saufferer et al. |
| 4,093,430 | A | 6/1978 | Schwab et al. |
| 4,576,029 | A | 6/1978 | Norman et al. |
| 4,110,086 | A | 8/1978 | Schwab et al. |
| 4,111,636 | A | 9/1978 | Goldberg |
| 4,118,202 | A | 10/1978 | Scholes |
| 4,219,001 | A | 8/1980 | Kumagai et al. |
| 4,260,394 | A | 4/1981 | Rich |
| 4,304,096 | A | 12/1981 | Liu et al. |
| 4,340,024 | A | 7/1982 | Suzuki et al. |
| 4,439,980 | A | 4/1984 | Biblarz et al. |
| 4,649,260 | A | 3/1987 | Melis et al. |
| 4,675,029 | A | 6/1987 | Norman et al. |
| 4,903,616 | A | 2/1990 | Mavroudis |
| 4,987,839 | A | 1/1991 | Krigmont et al. |
| 5,702,244 | A | 12/1997 | Goodson et al. |
| 6,640,549 | B1 | 11/2003 | Wilson et al. |
| 6,736,133 | B2 | 5/2004 | Bachinski et al. |
| 6,742,340 | B2 | 6/2004 | Nearhoof, Sr. et al. |
| 6,918,755 | B1 | 7/2005 | Johnson et al. |
| 7,137,808 | B2 | 11/2006 | Branston et al. |
| 7,168,427 | B2 | 1/2007 | Bachinski et al. |
| 7,182,805 | B2 | 2/2007 | Reaves |
| 7,226,496 | B2 | 6/2007 | Ehlers |
| 7,226,497 | B2 | 6/2007 | Ashworth |
| 7,243,496 | B2 | 7/2007 | Pavlik et al. |
| 7,377,114 | B1 | 5/2008 | Pearce |
| 7,523,603 | B2 | 4/2009 | Hagen et al. |
| 7,845,937 | B2 | 12/2010 | Hammer et al. |
| 8,082,725 | B2 | 12/2011 | Younsi et al. |
| 8,245,951 | B2 | 8/2012 | Fink et al. |
| 2005/0208442 | A1 | 9/2005 | Heiligers et al. |
| 2007/0020567 | A1 | 1/2007 | Branston et al. |
| 2008/0145802 | A1 | 6/2008 | Hammer et al. |
| 2011/0203771 | A1 | 8/2011 | Goodson et al. |
| 2012/0317985 | A1 | 12/2012 | Hartwick et al. |
| 2013/0004902 | A1 | 1/2013 | Goodson et al. |
| 2013/0071794 | A1 | 3/2013 | Colannino et al. |
| 2013/0170090 | A1 | 7/2013 | Colannino et al. |
| 2013/0230810 | A1 | 9/2013 | Goodson et al. |
| 2013/0230811 | A1 | 9/2013 | Goodson et al. |
| 2013/0255482 | A1 | 10/2013 | Goodson |
| 2013/0255548 | A1 | 10/2013 | Goodson et al. |
| 2013/0255549 | A1 | 10/2013 | Sonnichsen et al. |
| 2013/0260321 | A1 | 10/2013 | Colannino et al. |
| 2014/0227646 | A1* | 8/2014 | Krichtafovitch ..... F23N 5/00 431/2 |
| 2015/0147705 | A1* | 5/2015 | Colannino ..... F23D 14/82 431/2 |
| 2015/0226424 | A1* | 8/2015 | Breidenthal ..... F23C 99/001 431/8 |

OTHER PUBLICATIONS

William T. Brande; "The Bakerian Lecture: On Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

James Lawton et al., Electrical Aspects of Combustion, 1969, p. 81, Clarendon Press, Oxford, England.

Timothy J.C. Dolmansley et al., Electrical Modification of Combustion and the Affect of Electrode Geometry on the Field Produced, Modelling and Simulation in Engineering, May 26, 2011, 1-13, vol. 2011, Himdawi Publishing Corporation.

F. Altendorfner et al., Electric Field Effects on Emissions and Flame Stability with Optimized Electric Field Geometry, The European Combustion Meeting ECM 2007, 2007, 1-6, Germany.

* cited by examiner

BURNER SYSTEM WITH ANTI-FLASHBACK ELECTRODE

CROSS-REFERENCE TO RELATED APPLICATIONS

The present application claims priority benefit from U.S. Provisional Patent Application No. 61/653,722, entitled "LOW $NO_x$ LIFTED FLAME BURNER", filed May 31, 2012, and U.S. Provisional Patent Application No. 61/669,634, entitled "LOW NOx BURNER AND METHOD OF OPERATING A LOW NOx BURNER" filed Jul. 9, 2012, both of which, to the extent not inconsistent with the disclosure herein, are incorporated by reference in their entireties.

BACKGROUND

The danger of flame flashback can be present in burner systems that contain premixed fuel and air. Large volumes of premixed fuel and air can present an explosion hazard and a containment hazard.

What is needed is a technology to reduce the incidence of flame flashback.

SUMMARY

According to an embodiment, a premixed fuel burner includes a body defining a fuel and air mixing volume and a passage configured to allow flow of premixed fuel and air from the mixing volume to a combustion volume as a premixed fuel jet. A charge source is configured to apply a first polarity voltage or charge to a combustion fluid corresponding to the premixed fuel jet. The charge source can be arranged in various ways. The first polarity voltage or charge can be applied to the fuel before mixing, to the air before mixing, to the fuel and air in the mixing volume, to the premixed fuel jet, or to the flame. An anti-flashback electrode is configured to carry a voltage at the first polarity and to electrically repel the first polarity charge in the combustion fluid. Flames have relatively high conductivity compared to the fuel jet. The repulsion of the first polarity charge in the flame (the flame being a portion of the combustion fluid) causes the flame to be repelled from the anti-flashback electrode. The anti-flashback electrode is arranged to repel the flame from flashing back into the mixing volume.

In a premix burner, fuel and air are at least partially premixed in a mixing volume and the premixed fuel and air is output as a premixed fuel stream. A flame is supported with the premixed fuel stream. The presence of premixed fuel and air can create a hazard of "flashback", where the flame can travel upstream and ignite the mixed fuel and air in the mixing volume. According to an embodiment, a method for reducing the danger of flashback includes applying a first voltage or charge at a first polarity to a combustion fluid and applying a second voltage to an anti-flashback electrode disposed adjacent to the premixed fuel stream and arranged to repel the first voltage or charge from flowing upstream toward the premixed fuel and air. The first voltage or charge can be applied to various portions of combustion fluid, which includes the fuel, the air, premixed fuel and air, the premixed fuel stream, and the flame.

DETAILED DESCRIPTION

Figure 1:
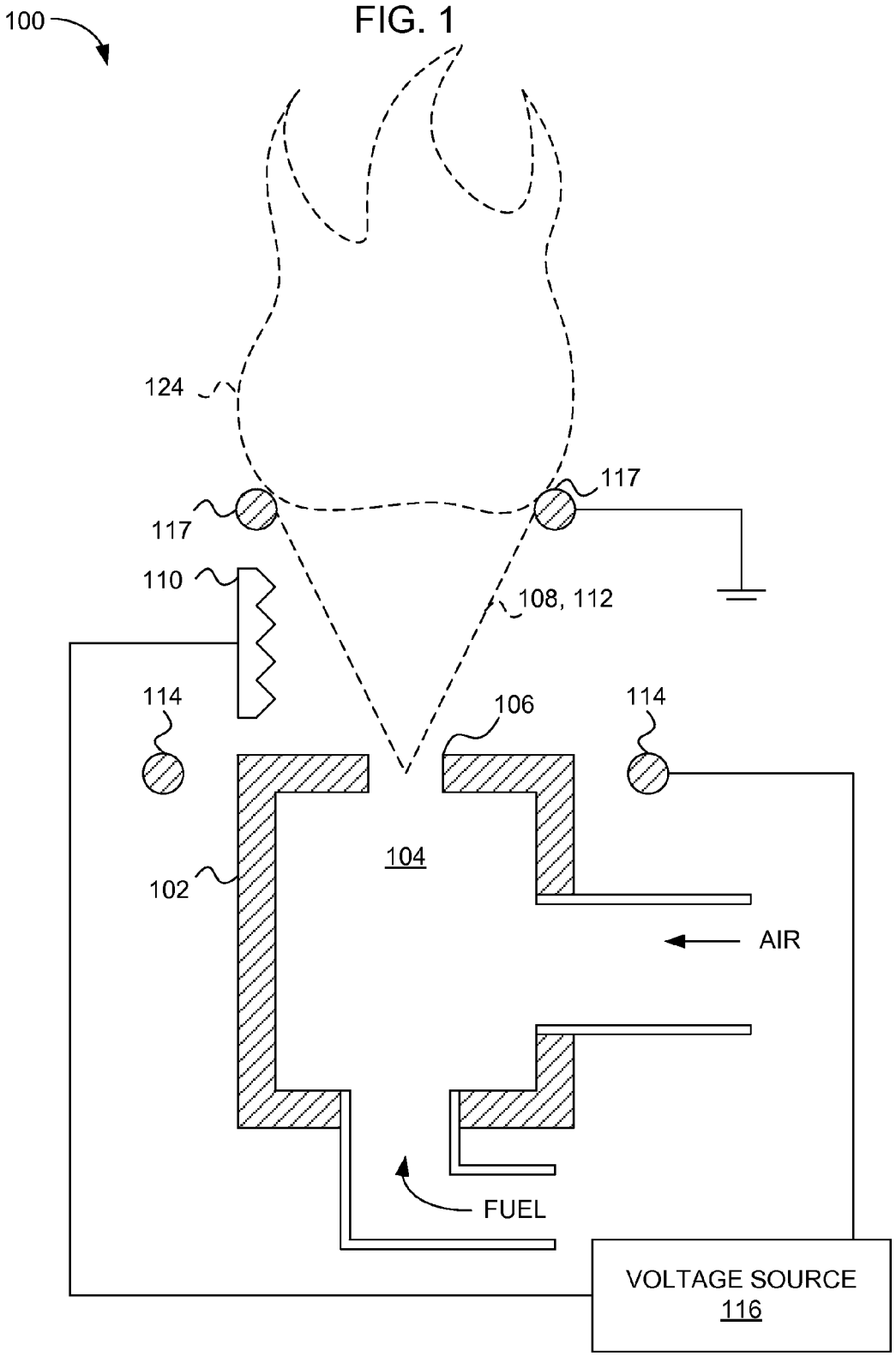
FIG. 1 is a diagram of a premixed fuel burner including a mechanism for preventing flashback, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a diagram of a premixed fuel burner 100, according to an embodiment. The premixed fuel burner 100 includes a body 102 defining fuel and air mixing volume 104 and a passage 106 configured to allow flow of a premixed fuel jet 108. The premixed fuel burner 100 includes a charge source 110 configured to apply a first polarity voltage or charge to a combustion fluid 112 corresponding to the premixed fuel jet 108. Additionally, the premixed fuel burner 100 includes an anti-flashback electrode 114 configured to carry a voltage at the first polarity and to electrically repel the first polarity charge in the combustion fluid 112.

The premixed fuel burner 100 includes a voltage source 116 operatively coupled to the charge source 110 and the anti-flashback electrode 114 and configured to output the first polarity voltage. Optionally, the voltage source 116 may include separate voltage supplies for the charge source 110 and the anti-flashback electrode 114. The voltage source 116 can be configured to output a substantially constant first polarity voltage. For example, in some embodiments, the voltage source 116 is configured to output a positive voltage.

Alternatively, the sign of the first polarity can vary with time. For example, the voltage source 116 can be configured to output an alternating current voltage. By synchronously modulating the polarity of the voltage or charge applied to the combustion fluid and the voltage applied to the anti-flashback electrode, the anti-flashback electrode repels the instantaneously like (alternating) charges in the flame 124.

According to an embodiment, the combustion fluid 112 includes the premixed fuel jet 108. The charge source 110 is configured to apply the first polarity voltage or charge to the mixed jet after the premixed fuel jet 108 is output through the passage 106.

According to an embodiment, a conductive flame-holding electrode 117 is configured to hold the flame 124 by providing an electrical attraction to the first polarity charges in the premixed fuel jet 108 and the flame 124. The conductive flame-holding electrode 117 can be held at ground voltage as indicated in FIG. 1. Alternatively, the conductive flame-holding electrode 117 can be driven to a flame-holding voltage opposite in polarity to the first polarity.

According to another embodiment, an aerodynamic bluff body can act as the flame holder. A bluff body can be made of a cast or extruded refractory material and/or ceramic.

Figure 2:
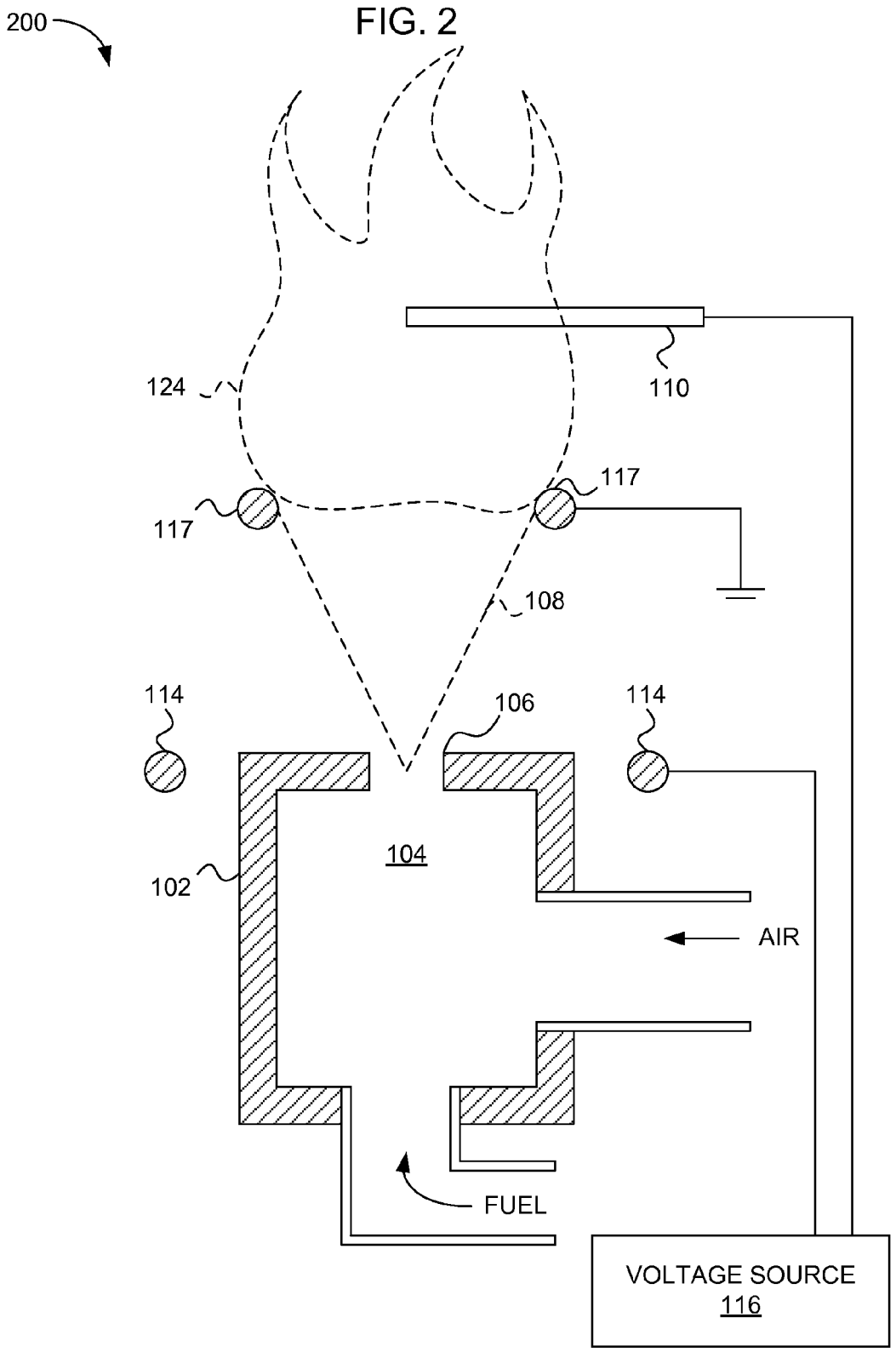
FIG. 2 is a diagram of a premixed fuel burner including a mechanism for preventing flashback, according to another embodiment.

FIG. 2 is a diagram of a premixed fuel burner 200, according to another embodiment. In the embodiment 200, the charge source 110 is configured to apply the first polarity voltage to the flame 124. The charge source 110 can be nearly any conductive material or shape, and does not eject charges into a dielectric region, as is done by a charge ejecting electrode depicted in FIG. 1. In an experimental apparatus, the charge source was a stainless steel rod partly immersed in the flame, and held at +15 kilovolts DC.

Figure 3:
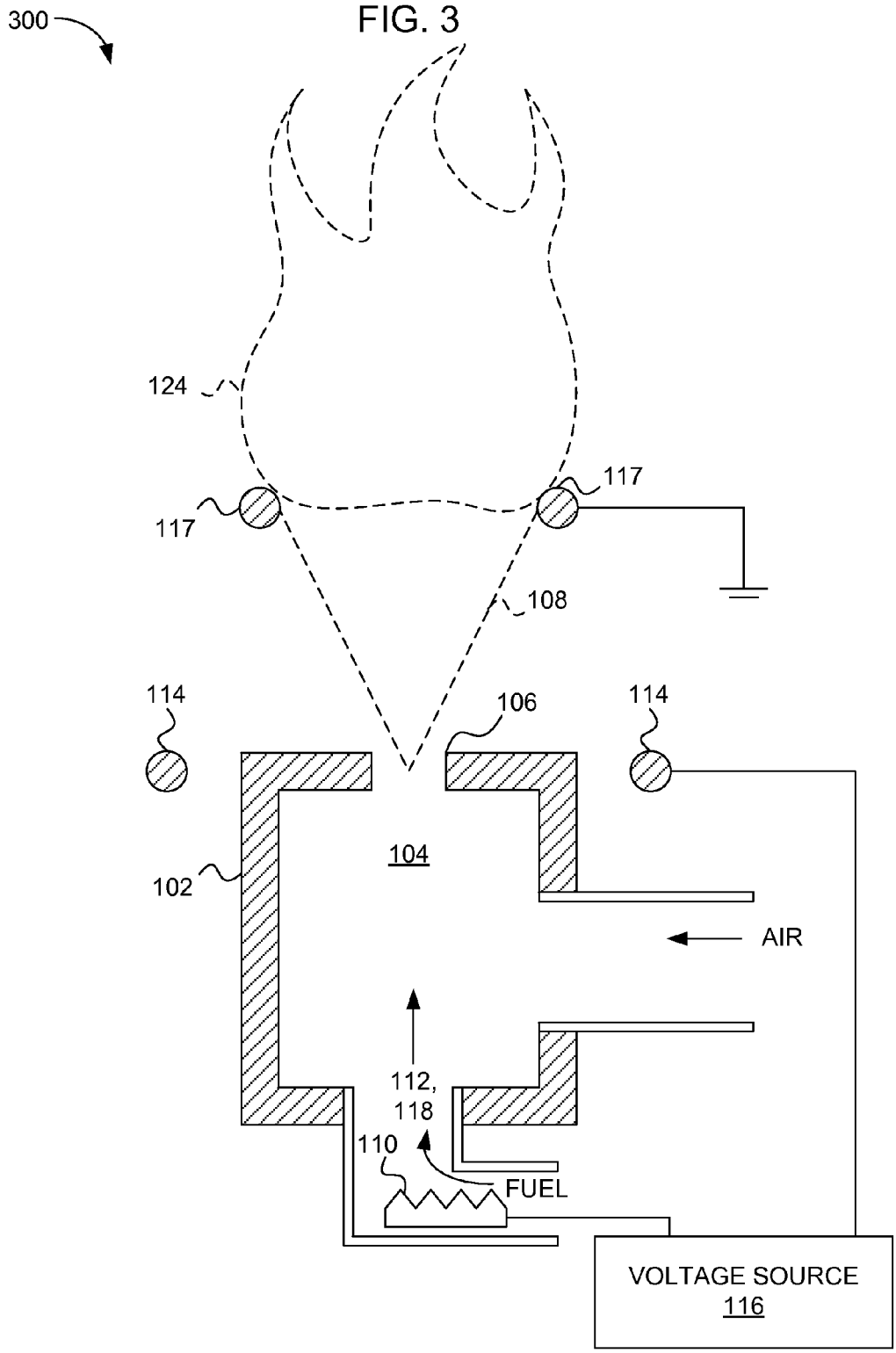
FIG. 3 is a diagram of a premixed fuel burner including a mechanism for preventing flashback, according to another embodiment.

FIG. 3 is a diagram of a premixed fuel burner 300, according to an embodiment wherein the charge source 110 includes a charge-ejecting or corona electrode configured to apply the first polarity charge to the fuel 118 before the fuel 118 enters the mixing volume 104. Typically, the walls of the mixing volume are held at the same polarity voltage as the charge source or are alternatively coated with a dielectric coating to minimize depletion of the charge concentration in the mixed fuel and air.

Figure 4:
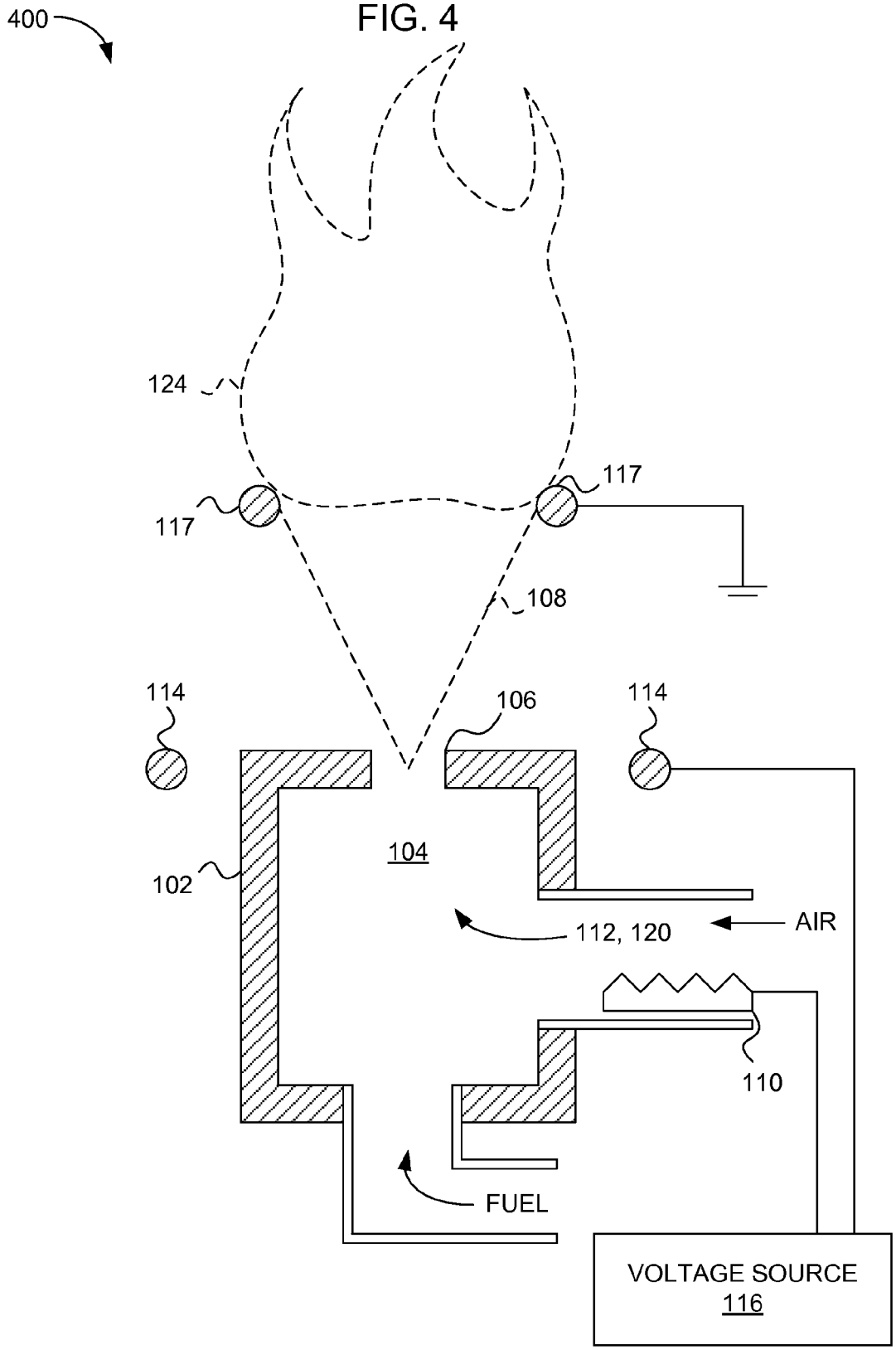
FIG. 4 is a diagram of a premixed fuel burner including a mechanism for preventing flashback, according to another embodiment.

FIG. 4 is a diagram of a premixed fuel burner 400, according to an embodiment wherein the charge source 110 includes a charge-ejecting or corona electrode configured to apply the first polarity charge to the air 120 before the air 120 enters the mixing volume 104. Typically, the walls of the mixing volume are held at the same polarity voltage as the charge source or are alternatively coated with a dielectric coating to minimize depletion of the charge concentration in the mixed fuel and air.

Figure 5:
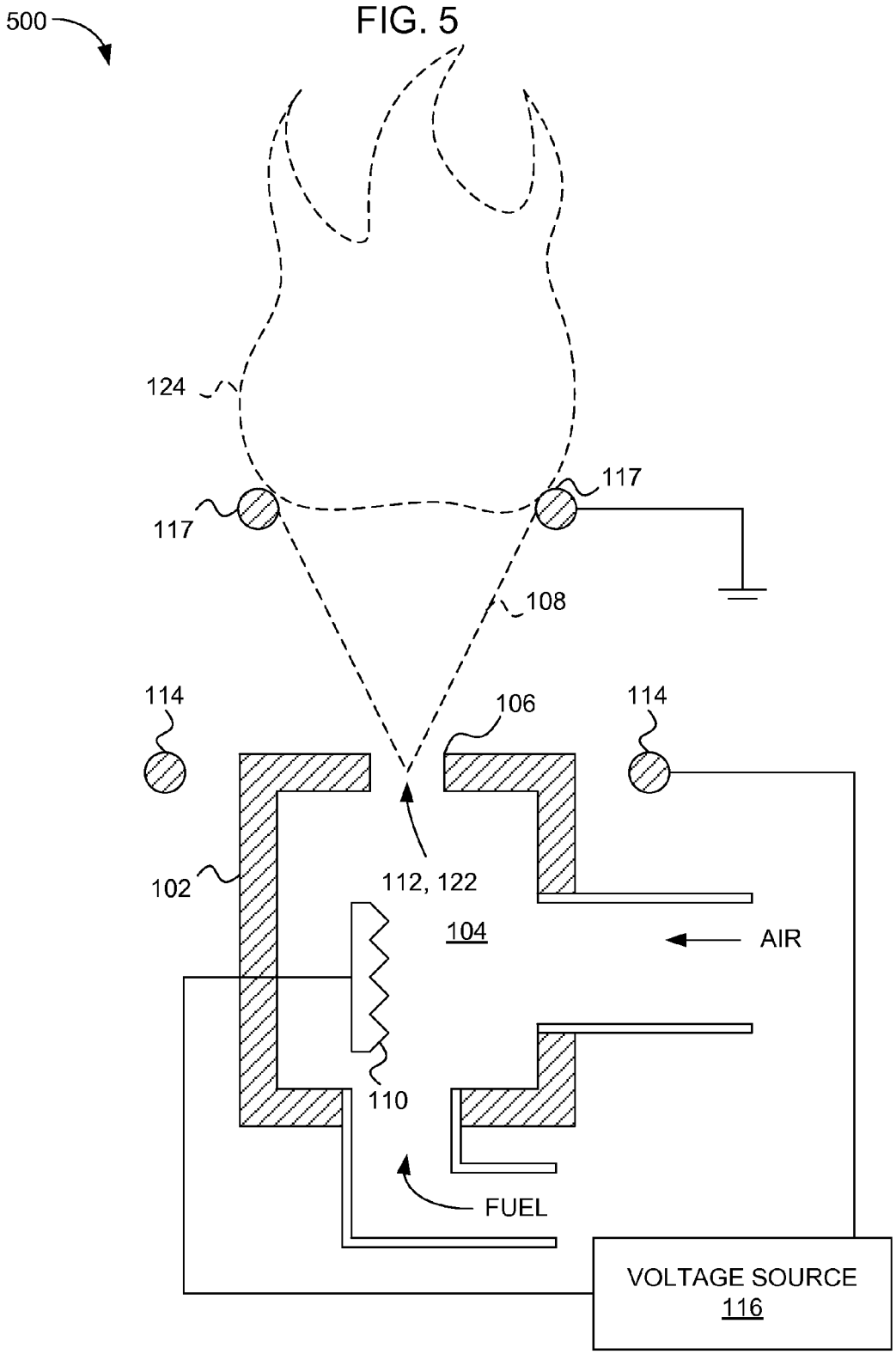
FIG. 5 is a diagram of a premixed fuel burner including a mechanism for preventing flashback, according to another embodiment.

FIG. 5 is a diagram of a premixed fuel burner 500, according to an embodiment wherein the charge source 110 includes a charge-ejecting or corona electrode configured to apply the first polarity voltage or charge to the mixed fuel and air 122 in the mixing volume 104. Typically, the walls of the mixing volume are held at the same polarity voltage as the charge source or are alternatively coated with a dielectric coating to minimize depletion of the charge concentration in the mixed fuel and air.

Various embodiments of anti-flashback electrodes are contemplated. As depicted diagrammatically in FIGS. 1-5, the anti-flashback electrode 114 can be configured as a ring electrode disposed peripheral to the passage 106 and outside the mixing volume 104, according to an embodiment.

Figure 6:
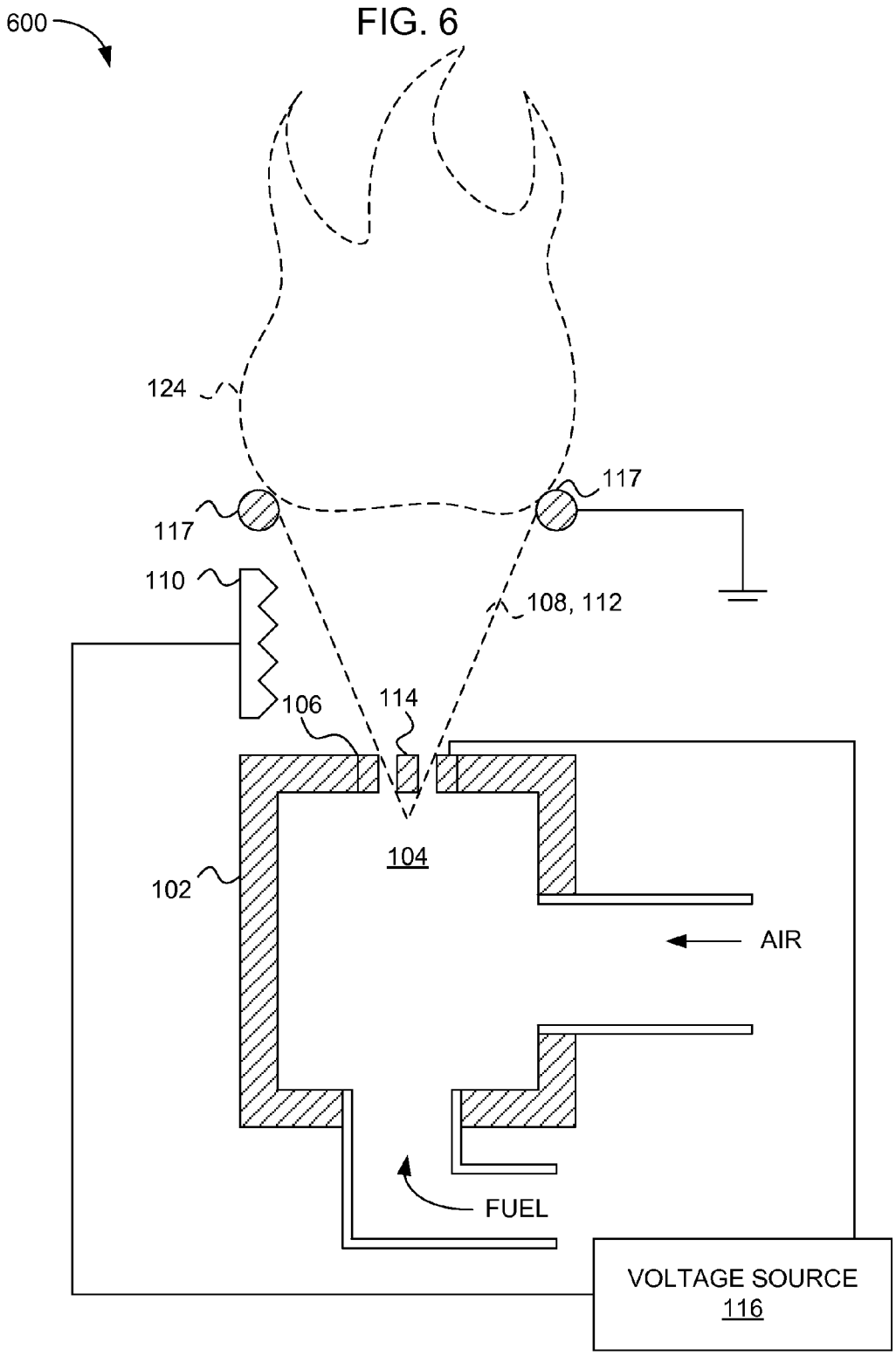
FIG. 6 is a diagram of a premixed fuel burner including a mechanism for preventing flashback, according to another embodiment.

FIG. 6 is a diagram of a premixed fuel burner 600 according to an embodiment wherein the anti-flashback electrode 114 includes a flame arrestor disposed as a grid across the passage 106.

Figure 7:
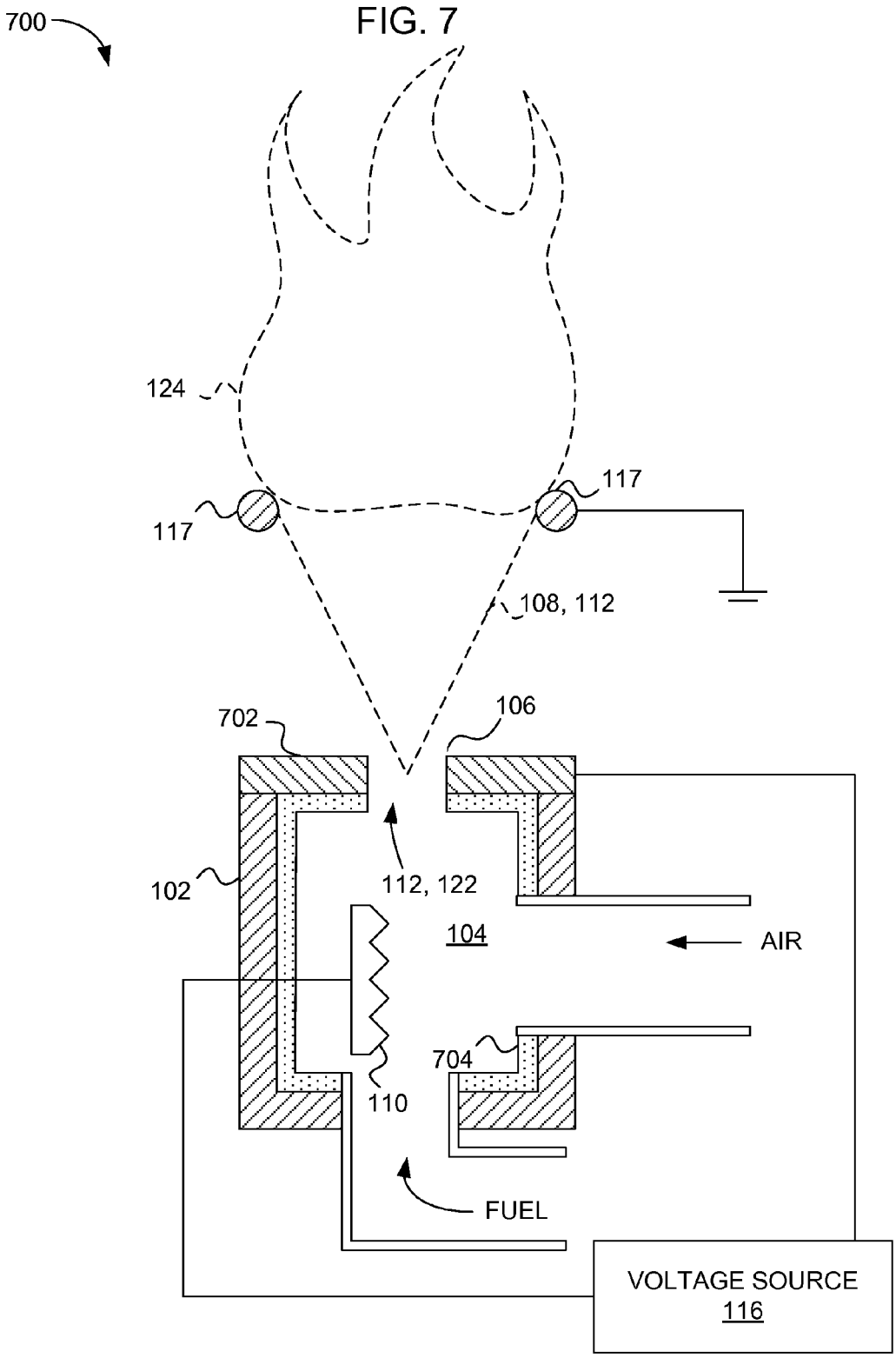
FIG. 7 is a diagram of a premixed fuel burner including a mechanism for preventing flashback, according to another embodiment.

FIG. 7 is a diagram of a premixed fuel burner 700, according to an embodiment wherein the anti-flashback electrode 114 includes at least a portion of the body 102 defining the mixing volume 104 including a region 702 of the wall of the mixing volume peripheral to the passage 106.

Also shown in FIG. 7 is insulation on the walls of the mixing volume, as described in conjunction with FIGS. 3-5. According to embodiments, the wall of the mixing volume 104 can include a dielectric layer 704 disposed on a surface of the wall contacting the fuel 118 and air in the mixing volume 104. The dielectric layer 704 can include a ceramic, a glass, a thermoplastic polymer, and/or a thermoset polymer, for example.

According to various embodiments, the burner can include a side-fired burner, an up-fired burner, or a down-fired burner.

According to an embodiment, the charge ejecting electrode and a counter electrode can be configured as an ionic wind generator operable to accelerate the premixed fuel jet 108 through the passage 106.

Figure 8:
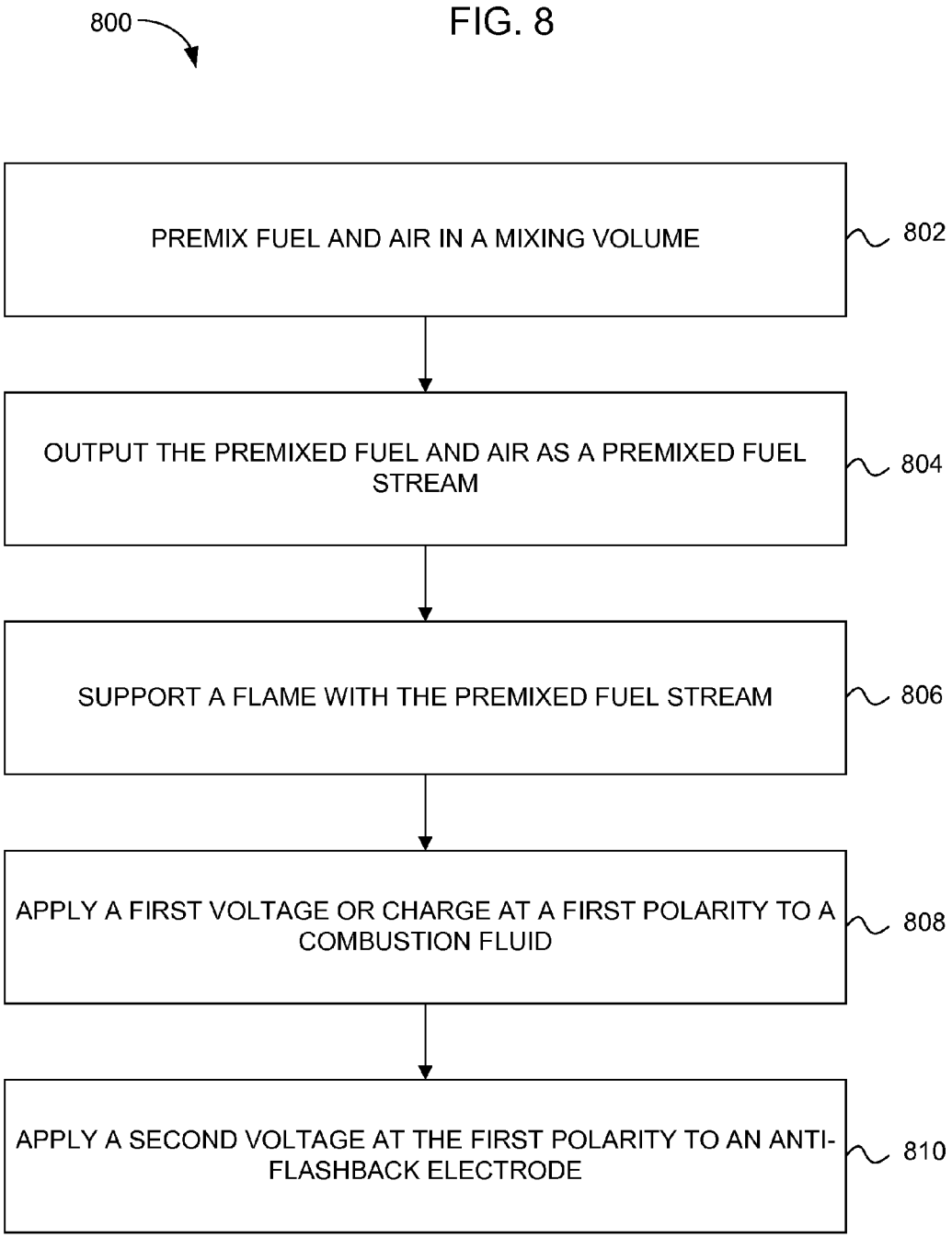
FIG. 8 is a flow chart illustrating a method for reducing a danger of flashback in a premixed fuel burner, according to an embodiment.

FIG. 8 is a flow chart of a method 800 for reducing the likelihood of flashback in a burner, according to an embodiment. Beginning at step 802 fuel and air are premixed in a mixing volume. Continuing to step 804, the premixed fuel and air is output as a premixed fuel stream. In step 806, a flame is supported with the premixed fuel stream.

Proceeding to step 808 a first voltage or charge at a first polarity is applied to a combustion fluid. According to various embodiments depicted above, the combustion fluid to which the first voltage or charge is applied can be the fuel, the air, premixed fuel and air, the premixed fuel stream, or the flame. According to an embodiment, step 808 includes applying a voltage at the first polarity to a charge-ejecting electrode to output charges at the first polarity. A charge-ejecting electrode is particularly appropriate when the charge-receiving combustion fluid is relatively non-conductive. Alternatively, step 808 can include applying a voltage at the first polarity to a non charge-ejecting electrode. A non charge-ejecting electrode is particularly appropriate when the charge-receiving combustion fluid is relatively conductive. The most conductive portion of the combustion fluid is typically the flame, and a non charge-ejecting electrode is most commonly used when the voltage is applied to the flame.

In one embodiment, Step 808 includes applying the first charge to the fuel before the fuel is mixed with the air. According to another embodiment, step 808 includes applying the first voltage or charge to the air before the fuel is mixed with the air. According to another embodiment, step 808 includes applying the first voltage or charge to the mixed fuel and air. According to another embodiment, step 808 includes applying the first voltage or charge to the premixed fuel stream. According to another embodiment, step 808 includes applying the first voltage to the flame.

Proceeding to step 810, a second voltage is applied to an anti-flashback electrode disposed adjacent to the combustion fluid and arranged to repel the first voltage or charge from flowing upstream toward the premixed fuel and air. According to an embodiment, step 810 includes applying the second voltage to a ring electrode disposed peripheral to the premixed fuel jet. According to another embodiment, step 810 includes applying the second voltage to a wall of a mixing volume disposed peripheral to the premixed fuel jet. According to another embodiment, step 810 includes applying the second voltage to a flame arrestor disposed across a passage between a mixing volume and a combustion volume.

The second voltage is the same polarity as the first voltage, at least instantaneously. As indicated above the first polarity charge or voltage can be a single-sign such as a DC voltage/charge concentration. Positive voltages placed on a flame (directly or as charges delivered from air or fuel) were found to be most effective for flame attraction and repulsion compared to negative voltages. Alternatively, the first polarity can vary in time, such as is produced from an AC voltage waveform. By synchronously varying the voltage placed on the charge source and the anti-flashback electrode, the system maintains instantaneous repulsion of the flame by the anti-flashback electrode.

According to embodiments, the charge concentration placed in the flame can be measured as about 15 kilovolt flame voltage.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A premixed fuel burner, comprising:

a body defining fuel and air mixing volume and a passage configured to allow flow of a premixed fuel jet;

a charge source configured to apply a first polarity voltage or charge to a combustion fluid corresponding to the premixed fuel jet; and an anti-flashback electrode configured to carry a voltage at the first polarity and to electrically repel the first polarity charge in the combustion fluid.

2. The premixed fuel burner of claim 1, further comprising:

a voltage source operatively coupled to the charge source and the anti-flashback electrode and configured to output the first polarity voltage.

3. The premixed fuel burner of claim 2, wherein the voltage source is configured to output a substantially constant first polarity voltage.

4. The premixed fuel burner of claim 3, wherein the voltage source is configured to output a positive voltage.

5. The premixed fuel burner of claim 2, wherein the voltage source is configured to output a time-varying first polarity voltage.

6. The premixed fuel burner of claim 1, wherein the combustion fluid includes the premixed fuel jet; and wherein the charge source is configured to apply the first polarity voltage or charge to the mixed jet after the premixed fuel jet is output through the passage.

7. The premixed fuel burner of claim 1, wherein the combustion fluid includes a flame supported by the premixed fuel jet; and wherein the charge source is configured to apply the first polarity voltage or charge to a flame supported by the premixed fuel jet.

8. The premixed fuel burner of claim 1, wherein the combustion fluid includes the fuel; and wherein the charge source is configured to apply the first polarity voltage or charge to the fuel before the fuel enters the mixing volume.

9. The premixed fuel burner of claim 1, wherein the combustion fluid includes the air; and wherein the charge source is configured to apply the first polarity voltage or charge to the air before the air enters the mixing volume.

10. The premixed fuel burner of claim 1, wherein the combustion fluid includes the mixed fuel and air; and wherein the charge source is configured to apply the first polarity voltage or charge to the mixed fuel and air in the mixing volume.

11. The premixed fuel burner of claim 1, wherein the anti-flashback electrode comprises a ring electrode disposed peripheral to the passage and outside the mixing volume.

12. The premixed fuel burner of claim 1, wherein the anti-flashback electrode comprises a flame arrestor disposed as a grid across the passage.

13. The premixed fuel burner of claim 1, wherein the anti-flashback electrode comprises at least a portion of the body defining the mixing volume including a region of a wall of the mixing volume peripheral to the passage.

14. The premixed fuel burner of claim 13, wherein the wall of the mixing volume further comprises a dielectric layer disposed on a surface of the wall contacting the fuel and air in the mixing volume.

15. The premixed fuel burner of claim 14, wherein the dielectric layer includes a ceramic.

16. The premixed fuel burner of claim 14, wherein the dielectric layer includes a glass.

17. The premixed fuel burner of claim 14, wherein the dielectric layer includes a thermoplastic polymer.

18. The premixed fuel burner of claim 14, wherein the dielectric layer includes a thermoset polymer.

19. The premixed fuel burner of claim 1, wherein the burner comprises a side-fired burner.

20. The premixed fuel burner of claim 1, wherein the burner comprises an up-fired burner.

21. The premixed fuel burner of claim 1, wherein the burner comprises a down-fired burner.

22. The premixed fuel burner of claim 1, wherein the charge source comprises a charge-ejecting electrode;

wherein the charge ejecting electrode and a counter electrode are configured as an ionic wind generator configured to accelerate the premixed fuel jet through the passage.

23. A method for reducing a possibility of flashback in a burner, comprising:

premixing fuel and air in a mixing volume;

outputting the premixed fuel and air as a premixed fuel stream;

supporting a flame with the premixed fuel stream;

applying a first voltage or charge at a first polarity to a combustion fluid corresponding to the fuel, the air, premixed fuel and air, the premixed fuel stream, or the flame; and applying a second voltage to an anti-flashback electrode disposed adjacent to the combustion fluid and arranged to repel the first voltage or charge from flowing upstream toward the premixed fuel and air.

24. The method for reducing a possibility of flashback in a burner of claim 23, wherein the second voltage is the same polarity as the first voltage.

25. The method for reducing a possibility of flashback in a burner of claim 23, wherein applying the first voltage or charge at the first polarity to a combustion fluid includes applying a voltage at the first polarity to a charge ejecting electrode to output charges at the first polarity.

26. The method for reducing a possibility of flashback in a burner of claim 23, wherein applying the first voltage or charge at the first polarity to a combustion fluid includes applying a voltage at the first polarity to a non-charge ejecting electrode to an electrically conductive portion of the combustion fluid.

27. The method for reducing a possibility of flashback in a burner of claim 23, wherein applying the first voltage or charge at the first polarity to a combustion fluid includes applying the first charge to the fuel before the fuel is mixed with the air.

28. The method for reducing a possibility of flashback in a burner of claim 23, wherein applying the first voltage or charge at the first polarity to a combustion fluid includes applying the first voltage or charge to the air before the fuel is mixed with the air.

29. The method for reducing a possibility of flashback in a burner of claim 23, wherein applying the first voltage or charge at the first polarity to a combustion fluid includes applying the first voltage or charge to the mixed fuel and air.

30. The method for reducing a possibility of flashback in a burner of claim 23, wherein applying the first voltage or charge at the first polarity to a combustion fluid includes applying the first voltage or charge to the premixed fuel stream.

31. The method for reducing a possibility of flashback in a burner of claim 23, wherein applying the first voltage or charge at the first polarity to a combustion fluid includes applying the first voltage to the flame.

32. The method for reducing a possibility of flashback in a burner of claim 23, wherein applying a second voltage to an anti-flashback electrode disposed adjacent to the combustion fluid and arranged to repel the first voltage or charge from flowing upstream toward the premixed fuel and air includes applying the second voltage to a ring electrode disposed peripheral to the premixed fuel jet.

33. The method for reducing a possibility of flashback in a burner of claim 23, wherein applying a second voltage to an anti-flashback electrode disposed adjacent to the combustion fluid and arranged to repel the first voltage or charge from flowing upstream toward the premixed fuel and air includes applying the second voltage to a wall of a mixing volume disposed peripheral to the premixed fuel jet.

34. The method for reducing a possibility of flashback in a burner of claim 23, wherein applying a second voltage to an anti-flashback electrode disposed adjacent to the combustion fluid and arranged to repel the first voltage or charge from flowing upstream toward the premixed fuel and air includes applying the second voltage to a flame arrestor disposed across a passage between a mixing volume and a combustion volume.

* * * * *